US009285097B2

(12) United States Patent
Lefler et al.

(10) Patent No.: US 9,285,097 B2
(45) Date of Patent: Mar. 15, 2016

(54) LED LIGHT ASSEMBLY AND METHOD FOR GENERATING A BEAM OF LIGHT

(75) Inventors: Walter W. Lefler, Rutherford, NJ (US); Marc B. Kaye, Davie, FL (US); David R. Sturdy, Wilmington, NC (US); James T. Carter, Wilmington, NC (US); Ronald L. Marsh, Wilmington, NC (US); Christopher J. Cornett, Hampstead, NC (US); Michael Wayne Appel, Durham, NC (US); Terry Lee Schmoeger, Raleigh, NC (US)

(73) Assignee: Aadyn Technology, LLC, Paramus, NJ (US)

( * ) Notice: Subject to any disclaimer, the term of this patent is extended or adjusted under 35 U.S.C. 154(b) by 696 days.

(21) Appl. No.: 13/440,730

(22) Filed: Apr. 5, 2012

(65) Prior Publication Data

US 2012/0257380 A1 Oct. 11, 2012

Related U.S. Application Data

(60) Provisional application No. 61/473,432, filed on Apr. 8, 2011.

(51) Int. Cl.

| | |
|---|---|
| ***F21V 5/04*** | (2006.01) |
| ***F21V 29/00*** | (2015.01) |
| ***F21L 4/02*** | (2006.01) |
| ***F21V 5/00*** | (2015.01) |

(Continued)

(52) U.S. Cl.

CPC . *F21V 5/04* (2013.01); *F21V 5/008* (2013.01); *F21V 21/30* (2013.01); *F21V 23/003* (2013.01); *F21V 29/70* (2015.01); *F21Y 2101/02* (2013.01); *F21Y 2105/001* (2013.01)

(58) Field of Classification Search

CPC ..... F21V 5/04; F21V 5/008
USPC ..... 362/157
See application file for complete search history.

(56) References Cited

U.S. PATENT DOCUMENTS 5,737,119 A 4/1998 Mladjan et al.
2001/0033726 A1 10/2001 Shie et al.

(Continued)

FOREIGN PATENT DOCUMENTS

CN 101761836 A 6/2010

OTHER PUBLICATIONS

Extended International Search Report of PCT/US12/32466, Sep. 1, 2014.

(Continued)

*Primary Examiner* — Jospeh L Williams
(74) *Attorney, Agent, or Firm* — Gregory J. Winsky; Jason F. Cotter; Archer & Greiner, P.C.

(57) ABSTRACT

A light emitting diode (LED) light assembly apparatus includes a housing, a lens stack, and a power supply assembly. The lens stack comprises an LED array of a plurality of LED light sources and a lens positioned in the housing with respect to the LED array to diffuse and focus light transmitted from the plurality of LED light sources and, thereby, provide a light beam out from the housing, the lens being operable to diffuse the transmitted light before focusing the transmitted light. The power supply assembly is operable to supply power to the lens stack and, thereby, power the plurality of LED sources. A method for making the beam of light is also provided.

19 Claims, 8 Drawing Sheets

(51) Int. Cl.

| | |
|---|---|
| *F21V 21/30* | (2006.01) |
| *F21V 23/00* | (2015.01) |
| *F21Y 105/00* | (2006.01) |
| *F21Y 101/02* | (2006.01) |
| *F21V 29/70* | (2015.01) |

(56) References Cited

U.S. PATENT DOCUMENTS

| | | | |
|---|---|---|---|
| 2003/0076237 | A1 | 4/2003 | Blumel |
| 2004/0120152 | A1 | 6/2004 | Bolta et al. |
| 2005/0190563 | A1 | 9/2005 | Li et al. |
| 2007/0019415 | A1 | 1/2007 | LeBlanc et al. |
| 2007/0279911 | A1 | 12/2007 | Kittelmann et al. |
| 2008/0303977 | A1 | 12/2008 | Sekiguchi et al. |
| 2008/0304536 | A1 | 12/2008 | Gold |
| 2009/0034255 | A1 | 2/2009 | Li |
| 2009/0168414 | A1 | 7/2009 | Bailey |
| 2009/0244887 | A1 | 10/2009 | Rubtsov |
| 2010/0165619 | A1 | 7/2010 | Kawato et al. |
| 2010/0302774 | A1 | 12/2010 | Van As |
| 2011/0062888 | A1 | 3/2011 | Bondy et al. |

OTHER PUBLICATIONS

International Search Report of PCT/US12/32466.

LED LIGHT ASSEMBLY AND METHOD FOR GENERATING A BEAM OF LIGHT

CROSS-REFERENCE TO RELATED APPLICATIONS

This application claims the priority, under 35 U.S.C. §119, of copending U.S. Provisional Patent Application No. 61/473,432, filed Apr. 8, 2011; the prior application is herewith incorporated by reference herein in its entirety.

STATEMENT REGARDING FEDERALLY SPONSORED RESEARCH OR DEVELOPMENT

Not Applicable

FIELD OF THE INVENTION

The present invention lies in the field of LED lighting. The present disclosure relates to an LED light assembly that first diffuses and then focuses the light transmitted from a plurality of light emitting diodes.

BACKGROUND OF THE INVENTION

Light emitting diode ("LED") lights require dramatically less power and generate less heat than traditional incandescent and halogen light bulbs. However, commercially available LED sources are still relatively low output on an individual basis. Therefore, multiple LED sources are needed to achieve the level of brightness of standard incandescent or halogen lights. A problem with using multiple LED sources is the resulting multiple-source shadow effect created by the multiple light sources. To minimize these shadows, many LED lights use a diffusion lens, which spreads the light to a much wider angle than the original intended focus.

Thus, a need exists to overcome the problems with the prior art systems, designs, and processes as discussed above.

SUMMARY OF THE INVENTION

The invention provides an LED light assembly and method for generating a beam of light that overcome the hereinaforementioned disadvantages of the heretofore-known devices and methods of this general type and that provide such features with a very tight LED array of multiple light sources and a lens that diffuses and re-focuses the light transmitted from the multiple LED sources to provide a more focused beam of light.

The present invention utilizes a new method for making a single beam of light, and, therefore, a single shadow even though the beam is generated from multiple LED sources. Then the beam is focused at a variety of degrees without losing significant flux on the light output. This benefit is accomplished by positioning the LED sources extremely close together, e.g., within a 5-inch diameter, by balancing the cooling and power feeding of the LED sources for maximum light output and long life, by diffusing the unfocused light with a diffusion pattern and at a distance, e.g., about 7.4 inches from the LED array, and by focusing the diffused light at a variety of degrees, e.g., a 5 degree spot to a 120 degree wash.

Although the invention is illustrated and described herein as embodied in an LED light assembly, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

Additional advantages and other features characteristic of the present invention will be set forth in the detailed description that follows and may be apparent from the detailed description or may be learned by practice of exemplary embodiments of the invention.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the present invention. Advantages of embodiments of the present invention will be apparent from the following detailed description of the exemplary embodiments thereof, which description should be considered in conjunction with the accompanying drawings in which.

DETAILED DESCRIPTION OF THE INVENTION

Figure 1:
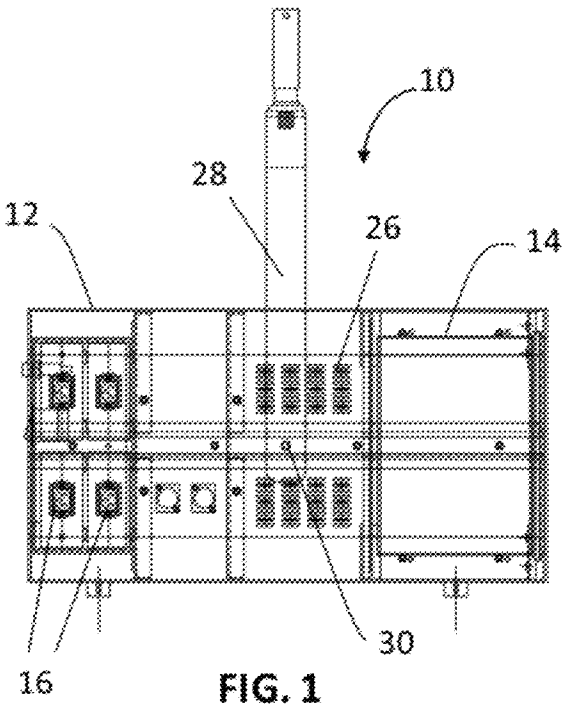
FIG. 1 is a side plan and hidden view of an exemplary LED light assembly according to the present invention.
Figure 2:
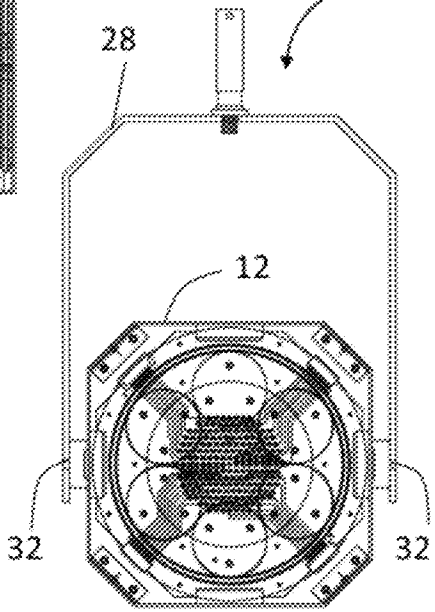
FIG. 2 is a front plan and hidden view of the LED light assembly of FIG. 1.
Figure 3:
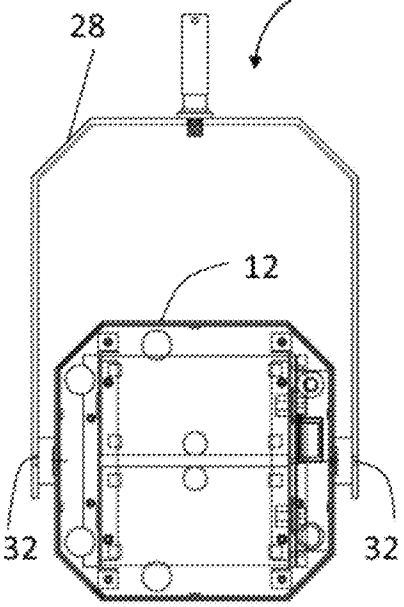
FIG. 3 is a rear plan and hidden view of the LED light assembly of FIG. 1.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Described now is an exemplary embodiment of the present invention. Referring now to the figures of the drawings in detail and first, particularly to FIG. 1, there is shown an exemplary embodiment of an LED light assembly 10 including a housing 12, a lens stack 14 disposed therein, and at least one power supply outlet 16. The lens stack 14 (further described in more detail below with respect to FIGS. 4 and 5) includes an LED array 18 of multiple LED sources 20 at one end of a barrel or tube 22 and a lens 24 at an opposing end of the tube 22. As shown in FIG. 1, the lens stack 14 is disposed within a front end of the housing 12 and the power supply 16 is disposed at the rear end of the housing. In the exemplary embodiment illustrated in FIG. 1, the LED light assembly 10 includes four power supply outlets 16.

As shown in FIG. 1, the housing 12 includes a plurality of vent holes 26 for dissipation of heat generated by the LED sources 20. The housing 12 may be formed from any material known in the art suitable for housing multiple light sources. The LED light assembly 10 may be ceiling-mounted by any suitable mounting assembly known in the art, e.g., an assembly used for ceiling-mounting large industrial lights. In this exemplary embodiment, the LED light assembly 10 is configured to hang from the ceiling by the yoke 28, which allows the LED light assembly 10 to pivot about an axis 30 defined by the points of attachment 32 between the yoke 28 and housing 12 for directing the light toward a particular object. In an exemplary embodiment, the housing 12 is between about 20 and 25 inches long and between about 10 and 12 inches wide.

Figure 5:
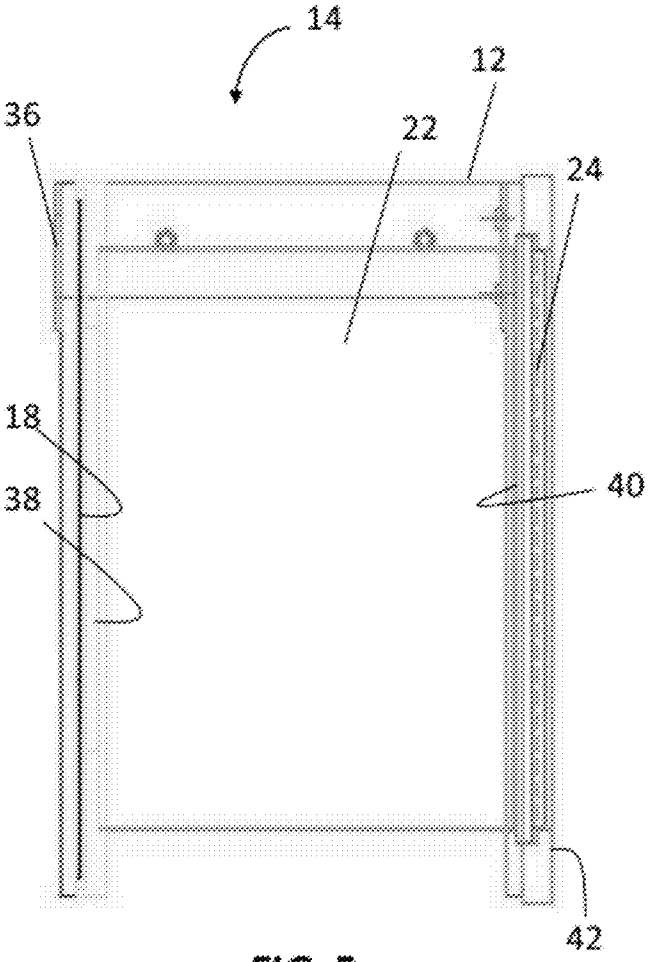
FIG. 5 is a side plan view of the lens stack of FIG. 4.
Figure 4:
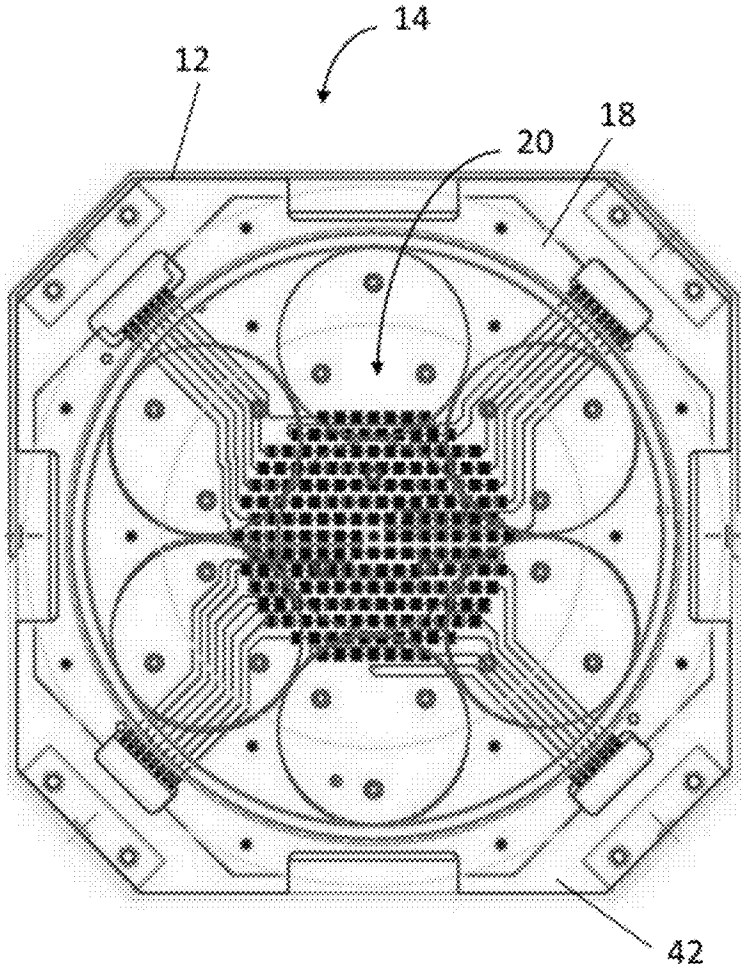
FIG. 4 is an enlarged front plan view of the lens stack of the LED light assembly of FIG. 1.

Referring now to FIGS. 4 and 5, the lens stack 14 is comprised of a tube 22 and a plurality of plates. The plurality of plates include (from left to right in FIG. 5): a heat sink 36; the LED array 18 attached to the heat sink 36; a plate 38 immediately adjacent the LED array 18 to help secure the LED array 18 in place within the lens stack 14; and another plate 40 for holding the lens 24 in place within the lens stack 14. The front housing panel 42 also secures the lens 24 in place within the lens stack 14. The tube 22 separates the plates 38 and 40 and channels the light from the multiple LED sources 20 of the LED array 18 toward the lens 24. The plates 38 and 40, of course, in no way inhibit the transmission of the light from the LED sources 20 to the lens 24. In an exemplary embodiment, the tube 22 is between about 7.0 and about 7.5 inches long so that the lens 24 is distanced from the LED array 18 by about the same distance. Varying the length of tube 22 or the distance between LED array 18 and lens 24 will change the focus of the light. The length of the tube or the distance between the LED array and the lens can be longer depending of the lens used. If the distance or tube is too short, an artifact caused by the dimple pattern and rings of the lens can be seen in the light beam.

Figure 6:
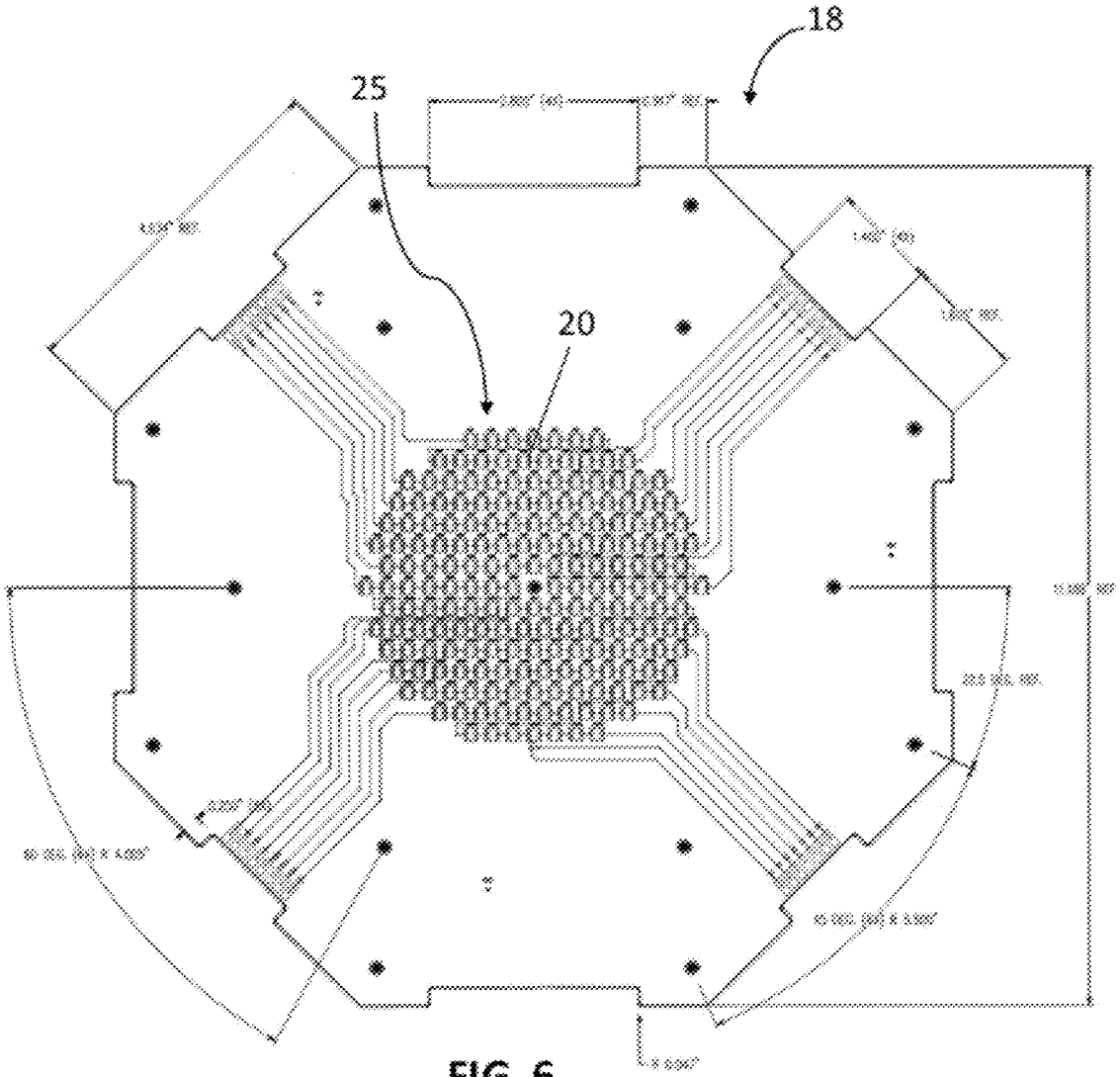
FIG. 6 is an enlarged front plan view of the LED array of the LED light assembly of FIG. 1.
Figure 8:
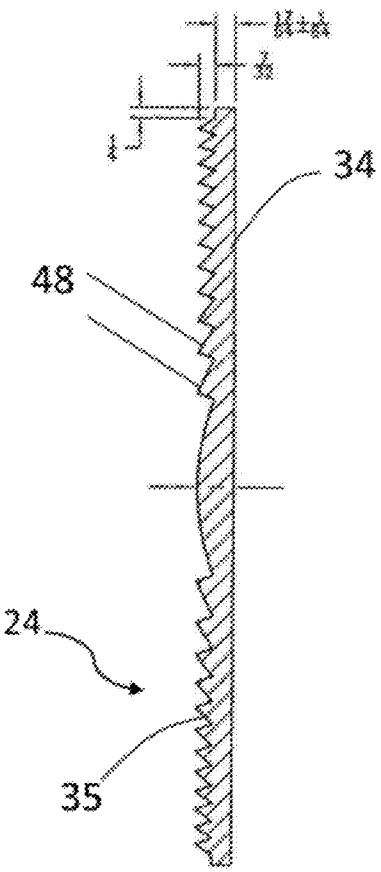
FIG. 8 is a side plan view of the lens of FIG. 7.
Figure 7:
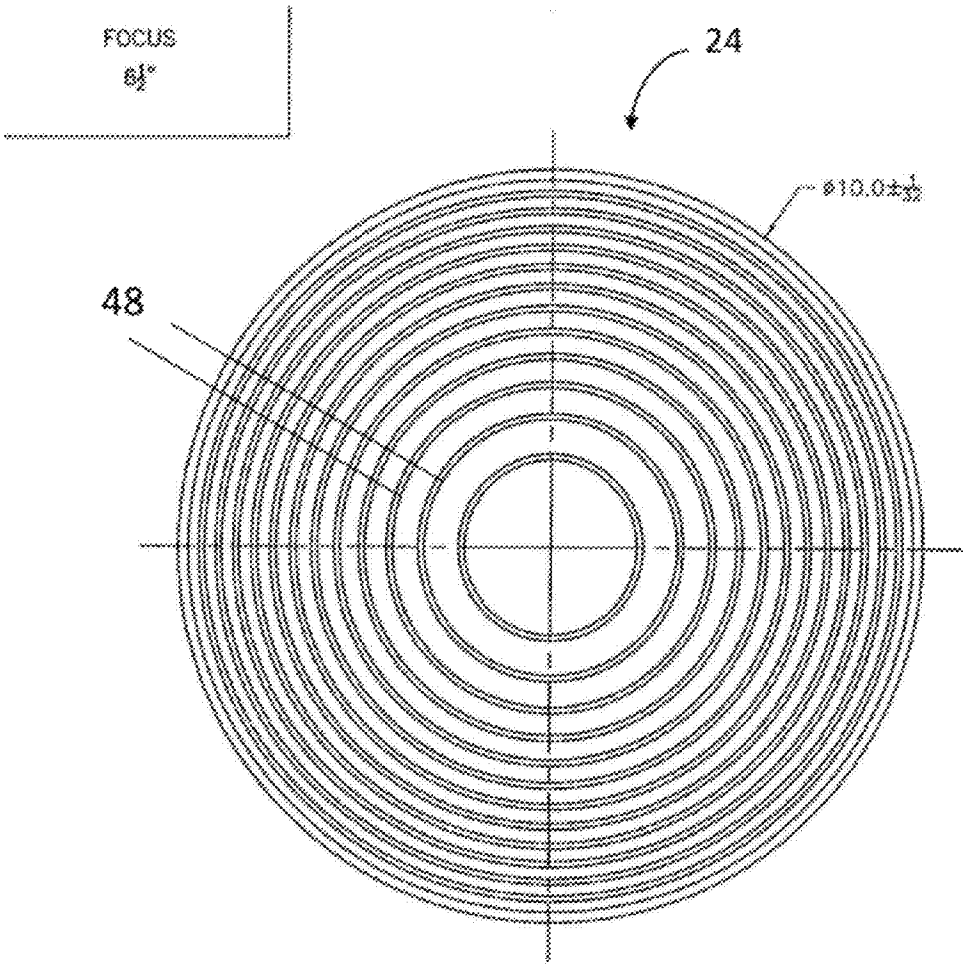
FIG. 7 is an enlarged front plan view of the lens of the LED light assembly of FIG. 1.

As shown in FIG. 6, the LED array 18 includes a tightly held cluster 25 of multiple LED sources 20. In an exemplary embodiment, the cluster 25 of LED sources 20 includes between about 185 and 195 individual LED sources 20 and measures between about 5 and about 6 inches in diameter. In one particular embodiment, the cluster 25 includes 192 LED sources 20 within a 5-inch diameter array, and the lens 24 is distanced 7.4 inches from the LED array 18.

Figure 9:
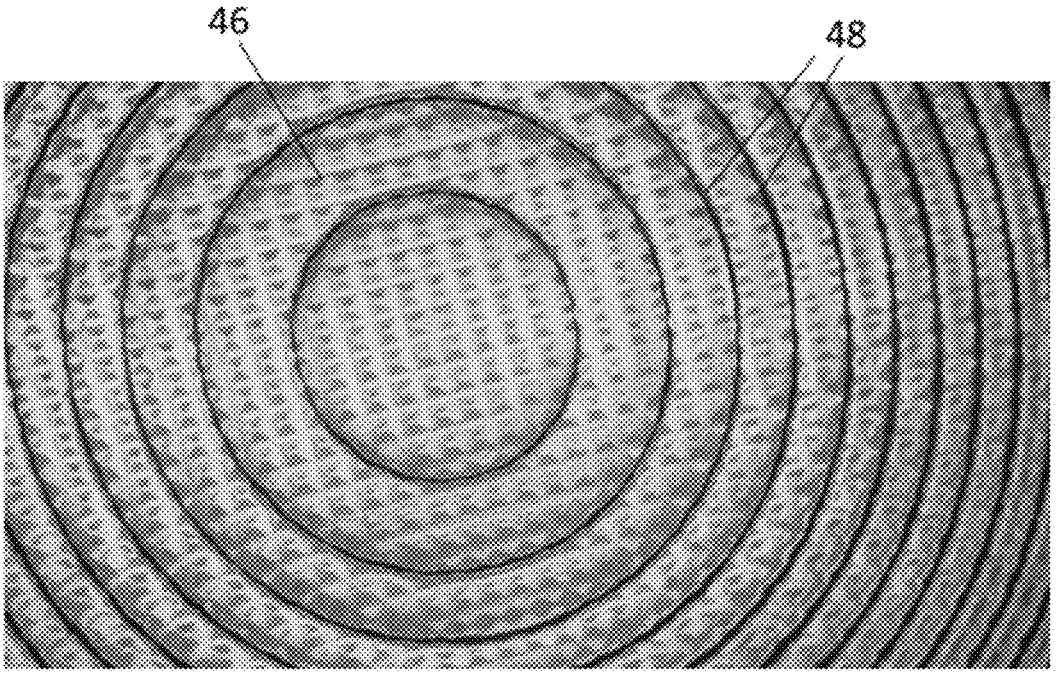
FIGS. 9 and 10 are photographs of fragmentary, enlarged, front plan views of the lens of FIG. 7.
Figure 10:
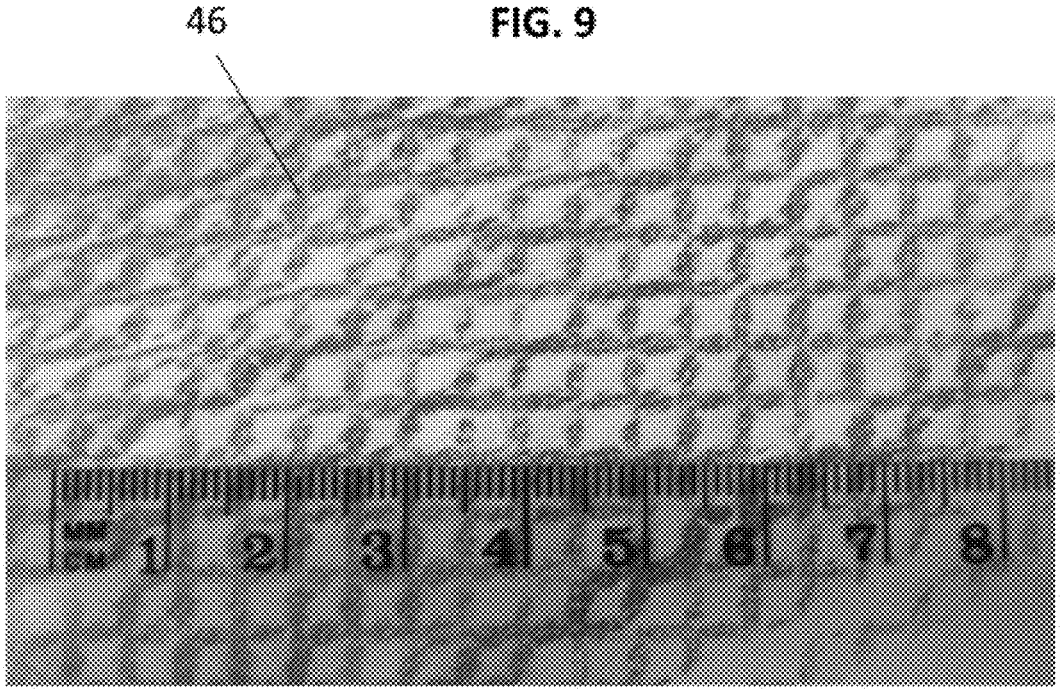

Referring now to FIGS. 7 to 10, the lens 24 is provided with a diffusion pattern 46 formed on the backside 34, i.e., the side facing the LED array 18, although visible from the front side 35. The lens 24 also includes a plurality of focusing rings 48 formed on the front side 35, i.e., the side facing the outside environment of the LED light assembly 10. In this exemplary embodiment, the lens 24 is about 1 inch thick. As best shown in FIGS. 9 and 10, an exemplary diffusion pattern includes a stippling pattern of polygonal shapes, each measuring about 0.5 cm by about 0.5 cm. The lens 24 may be made of any suitable material known by one of ordinary skill in the art, e.g., LEXAN. Rather than forming a diffusion pattern 46 on the backside 34 of the lens 24, an alternative embodiment may incorporate a separate diffusion film or lens immediately adjacent the backside 34 of the lens 24.

Current LED light assemblies attempt to focus the LEDs at the array source and then diffuse the light transmitted therefrom to eliminate the multiple-shadow effect. This diffusion spreads out the light to a much wider angle than the original intended focus. Thus, current LED light assemblies are not desirable in situations where a stronger beam of focused light is needed. Unlike current LED light assemblies, the LED light assembly 10 according to the present invention diffuses the light transmitted from the LED sources 20 before any focus is attempted. The light from the LED sources 20 of the tightly held cluster 25 of the LED array 18 is transmitted through the tube 22 and is diffused by the diffusing pattern 46 of the lens 24 and, as the light subsequently passes through the lens 24, the focusing rings 48 of the lens 24 focus the light. The LED light assembly 10 has the ability to focus the light to a spot of about 5 degrees. Typically, in every diffusion or focusing step, there is about a 10% to 15% light output loss. Thus, since the diffusing and focusing steps are essentially combined into a single step in the exemplary embodiment, the LED light assembly 10 only cuts down the light output once, as opposed to multiple times as is currently done with current LED light assemblies.

In alternative embodiments, where the diffusion is through a separate film or lens, the position of the lens 24 relative to the diffusion film or lens may be adjusted to achieve a wider spread of light, e.g., about 30 degrees.

In an exemplary embodiment, the LED sources 20 are XLamp® XM-L LEDs designed by Cree, Inc. The LED sources deliver 1000 lumens with 100 lumens per watt efficacy at 3 Amps. In a compact 5-mm-by-5-mm footprint, they offer the unique combination of very high efficacy at very high drive currents, delivering light output and efficacy of 160 lumens per watt at 350 mA and up to 315 lumens and 150 lumens per watt at 700 mA. The LED light assembly 10 of the present invention has the ability to develop a single source beam with no multiple shadows using about 192 LED sources in a confined space and dissipate the heat so that the LED sources 20 will last approximately 50,000 hours. The LED light assembly 10 may have an output approaching 4,000 watts while only using about 5 Amps of power.

Figure 11:
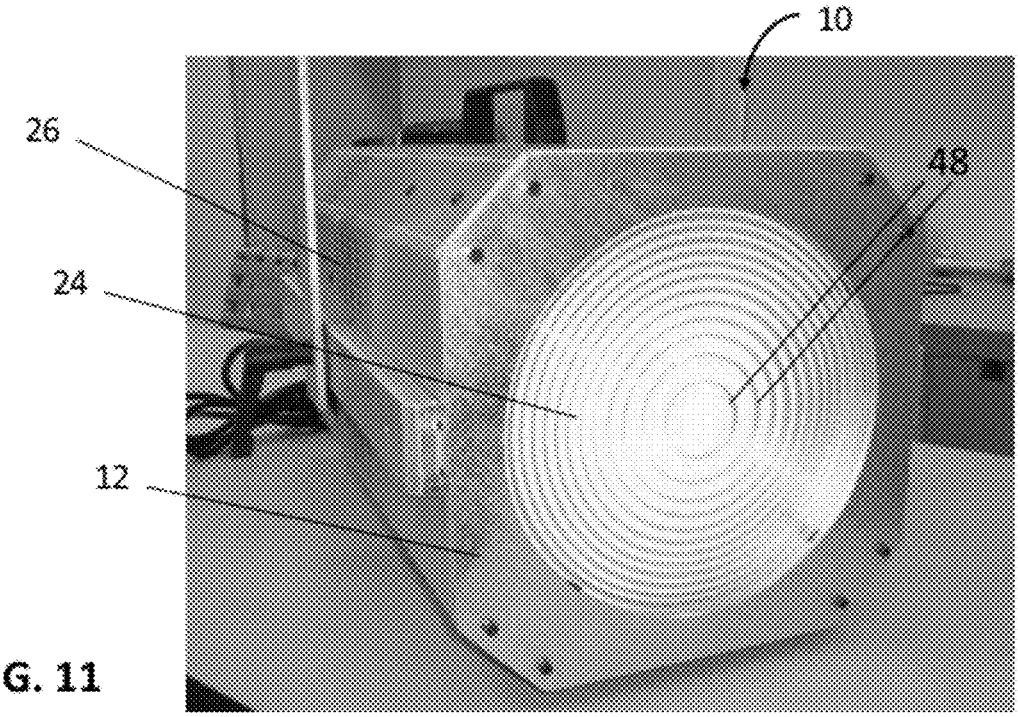
FIG. 11 is a photograph of a perspective view of an exemplary embodiment of an LED light assembly according to the present invention.
Figure 12:
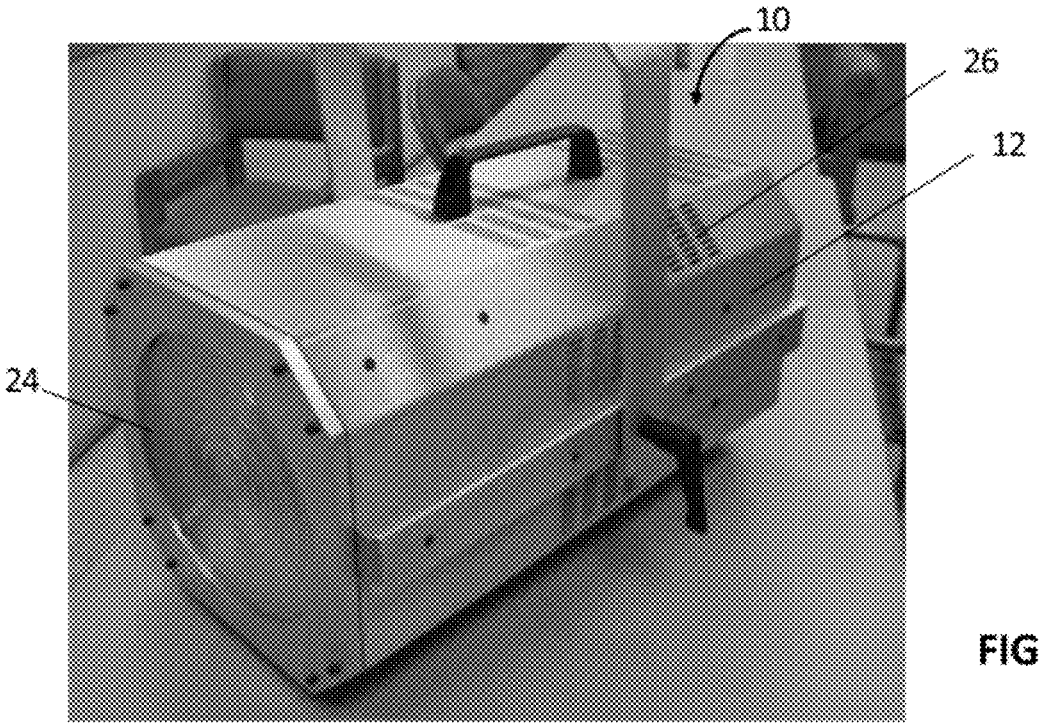
FIG. 12 is a photograph of a perspective top view of the LED light assembly of FIG. 11.

FIG. 11 is a photograph of a perspective view of an exemplary embodiment of an LED light assembly 10. FIG. 12 is a photograph of a perspective top view of the LED light assembly of FIG. 11. Both FIGS. 11 and 12 show a housing 12 that includes a plurality of vent holes 26 for dissipation of heat generated by the LED sources (not shown) and a lens 24. Lens 24 includes a plurality of focusing rings 48 formed on the front side, i.e., the side facing the outside environment of the LED light assembly 10.

Figure 13:
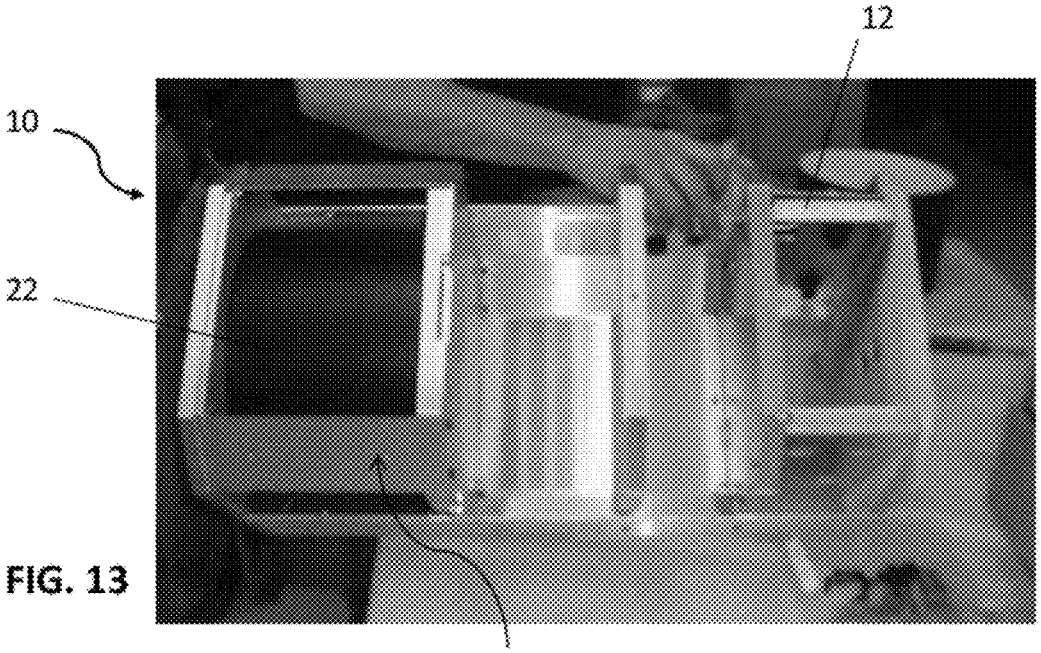
FIG. 13 is a photograph of a perspective side view of the interior of the LED light assembly of FIG. 11.
Figure 14:
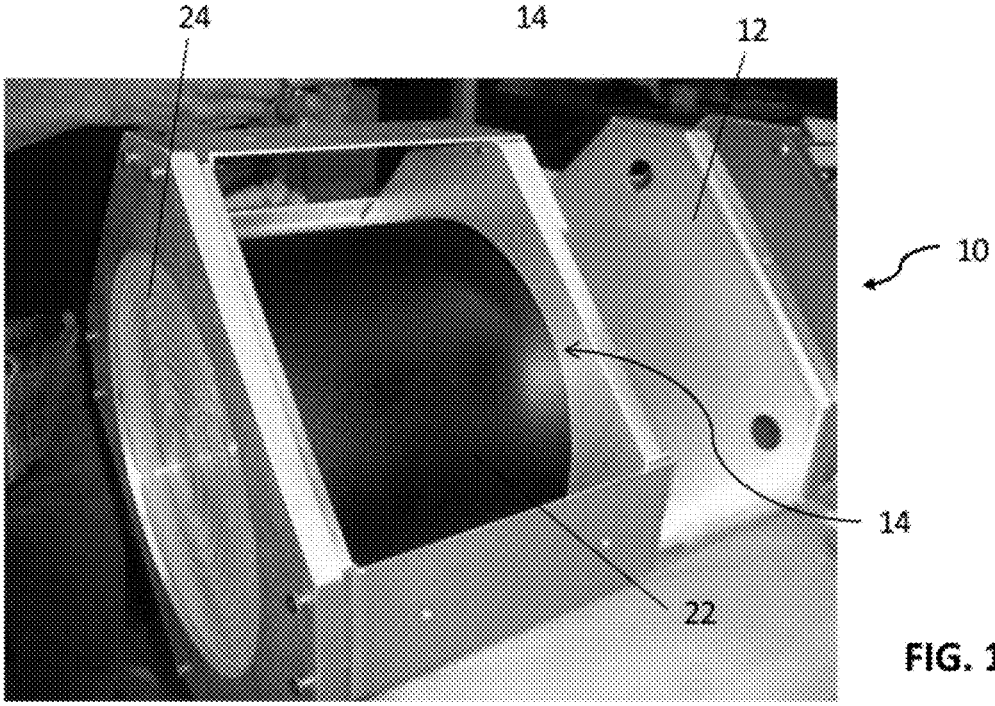
FIG. 14 is a photograph of a fragmentary, perspective view of the interior of the LED light assembly of FIG. 11.

FIG. 13 is a photograph of a perspective side view of the interior of the LED light assembly of FIG. 11. FIG. 14 is a photograph of a fragmentary, perspective view of the interior of the LED light assembly of FIG. 11. Both FIGS. 13 and 14 show a lens stack 14 having a tube 22. The lens stack 14 also is comprised of a plurality of plates (not shown). Tube 22 channels the light from the multiple LED sources (not shown) of an LED array (not shown) toward the lens 24.

Figure 15:
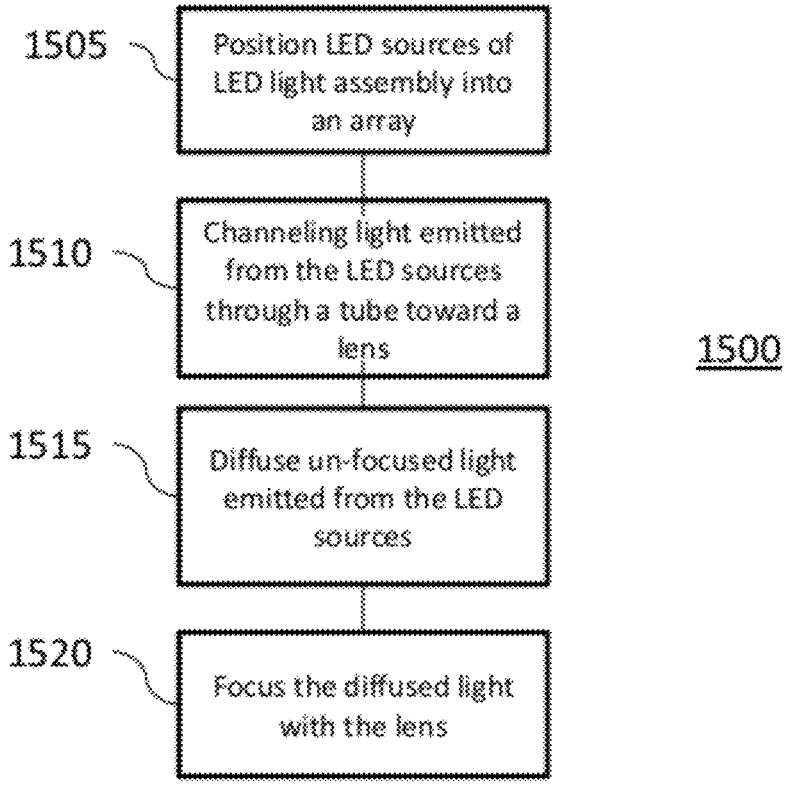
FIG. 15 is a block diagram of a method for making a single beam of light, according to one embodiment.

FIG. 15 illustrates a method 1500 for making a single beam of light, according to one exemplary embodiment. Method 1500 may be used in conjunction with the device(s) as shown in FIGS. 1 to 14. Method 1500 begins at block 1505, where LED sources of an LED light assembly are positioned into an array as described herein. In one exemplary embodiment, the LED array includes a tightly held cluster of multiple LED sources. In a particular exemplary embodiment, the cluster of LED sources includes between about 185 and 195 individual LED sources and measures between about 5 and about 6 inches in diameter.

At block 1510, a tube channels light from the array of LED sources to a lens. The lens may be 1.0 inch thick. The lens may be distanced at least 7.0 inches from the array. In one particular embodiment, the cluster includes 192 LED sources within a 5-inch diameter array, and a lens is distanced 7.4 inches from the LED array.

In one embodiment, cooling and power feeding of the LED sources is balanced. There is a balance between the amount of power feeding the LEDs and the cooling of the LEDs. More power will make the light brighter until the LEDs get too hot, at this point the brightness output will diminish. A single source beam without multiple shadows may be developed using about 192 LED sources in a confined space and dissipation of the heat according to the embodiment is performed so that the LED sources will last approximately 50,000 hours. In such a configuration, an output approaching 4,000 watts is provided while only using about 5 Amps of power.

At block 1515, unfocused light is diffused with a diffusion pattern set at a predetermined distance away from the array. In one exemplary embodiment, the diffusion pattern may be formed on a backside of the lens. In this embodiment, the backside of the lens is the side of the lens facing the LED sources.

An exemplary diffusion pattern includes a stippling pattern of polygonal shapes, each measuring approximately 0.5 cm by 0.5 cm. In an alternative embodiment, a separate diffusion film or lens is formed immediately adjacent the backside of the lens. When diffusion is through a separate film or lens, the position of the lens relative to the diffusion film or lens may be adjusted to achieve a wider spread of light.

At block 1520, the diffused light is focused. As diffused light from the LED sources passes through the lens, focusing rings of the lens focus the light. Light may be focused to a spot of about 5 degrees. The diffusing and focusing steps can be combined into a single step, thus cutting down light output once.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A light emitting diode (LED) light assembly apparatus, comprising:

a housing;

a lens stack comprising:

an LED array of a plurality of LED light sources; and a unitary lens positioned in the housing with respect to the LED array to diffuse and focus light transmitted from the plurality of LED light sources and, thereby, provide a light beam out from the housing, the unitary lens being operable to diffuse the transmitted light before focusing the transmitted light; and at least one power supply assembly operable to supply power to the lens stack and, thereby, power the plurality of LED light sources.

2. The apparatus according to claim 1, wherein the lens stack comprises:

a tube; and a plurality of plates at the tube, the LED array being disposed on one of the plates to transmit light from the plurality of LED light sources into an interior of the tube.

3. The apparatus according to claim 2, wherein:

the one plate is a first plate securing the LED array in place within the tube of the lens stack; and a second of the plurality of plates different from the first plate comprises a heat sink operable to conduct heat from the LED array.

4. The apparatus according to claim 3, wherein the tube:

separates the unitary lens from the first plate with the LED array; and channels light from the plurality of LED light sources through the tube toward the unitary lens.

5. The apparatus according to claim 1, wherein the unitary lens is separated from the LED array at a distance of between approximately 7.0 inches to approximately 7.5 inches.

6. The apparatus according to claim 1, wherein the LED array comprises a cluster of between 185 and 195 LED light sources.

7. The apparatus according to claim 6, wherein the cluster is disposed within a circle of no greater than approximately 6 inches in diameter.

8. The apparatus according to claim 1, wherein the unitary lens has a diffusion pattern formed on a side facing the LED array.

9. The apparatus according to claim 8, wherein the diffusion pattern is a stippling pattern of polygonal shapes.

10. The apparatus according to claim 8, wherein the diffusion pattern is a separate diffusion film adjacent a side of the unitary lens facing the LED array.

11. The apparatus according to claim 10, wherein a position of the unitary lens relative to the diffusion film is adjusted to achieve a wider spread of light.

12. The apparatus according to claim 1, wherein the unitary lens has a plurality of focusing rings formed on a side facing an outside environment of the LED light assembly.

13. The apparatus according to claim 12, wherein the unitary lens is approximately 1 inch thick.

14. A method for generating a single beam of light, which comprises:

positioning light emitting diode (LED) sources of an LED light assembly into an array cluster having an outer diameter of no greater than 6 inches, the LED sources having a balanced cooling and power feed;

channeling light emitted from the LED sources through a tube toward a unitary lens;

diffusing unfocused light emitted from the LED sources with a diffusion pattern set at a predetermined distance from the array on a side of the unitary lens facing the LED sources; and focusing the diffused light with the unitary lens.

15. The method according to claim 14, wherein the unitary lens is separated from the array at a distance of between approximately 7.0 inches to approximately 7.5 inches.

16. The method according to claim 14, wherein:

the diffusion pattern is a separate diffusion film adjacent a side of the unitary lens facing the array; and a position of the unitary lens relative to the diffusion film is adjusted to achieve a wider spread of light.

17. The method according to claim 14, wherein the unitary lens has a plurality of focusing rings formed on a side facing an outside environment of the LED light assembly.

18. The method according to claim 14, wherein the unitary lens is approximately 1 inch thick.

19. The method according to claim 14, wherein the array comprises a cluster of between 185 and 195 LED light sources.

* * * * *